United States Patent [19]

Feldstein

[11] Patent Number: 4,827,633

[45] Date of Patent: May 9, 1989

[54] RETRACTABLE BICYCLE SHOE CLEAT

[76] Inventor: Frank I. Feldstein, 515 S. Huntington Ave., Monterey Park, Calif. 91754

[21] Appl. No.: 193,102

[22] PCT Filed: Oct. 3, 1986

[86] PCT No.: PCT/US86/02086

§ 371 Date: Oct. 3, 1986

§ 102(e) Date: Oct. 3, 1986

[87] PCT Pub. No.: WO87/07120

PCT Pub. Date: Dec. 3, 1987

[51] Int. Cl.[4] ..... A43B 5/14; G05G 1/14

[52] U.S. Cl. ..... 36/131; 74/594.6

[58] Field of Search ..... 36/131, 62, 65; 74/594.6

[56] References Cited

U.S. PATENT DOCUMENTS

| | | | |
|---|---|---|---|
| 550,409 | 11/1895 | Hanson | 36/131 |
| 590,685 | 9/1897 | Matthews | 36/131 |
| 4,298,210 | 11/1981 | Lotteau et al. | 36/131 |
| 4,377,952 | 3/1983 | Gamodes | 36/131 |
| 4,506,463 | 3/1985 | Chassaing | 36/131 |
| 4,538,480 | 9/1985 | Trindle | 36/131 |

FOREIGN PATENT DOCUMENTS

| | | | |
|---|---|---|---|
| 0146761 | 7/1985 | European Pat. Off. | 36/131 |
| 2240102 | 2/1974 | Fed. Rep. of Germany | 36/131 |
| 3315282 | 10/1984 | Fed. Rep. of Germany | 36/131 |
| 3329993 | 3/1985 | Fed. Rep. of Germany | 74/594.6 |
| 2432427 | 2/1980 | France | 36/131 |
| 2464661 | 3/1981 | France | 36/131 |

*Primary Examiner*—Steven N. Meyers

*Attorney, Agent, or Firm*—Albert O. Cota

[57] ABSTRACT

A racing bicycle shoe cleat which has a shoe mounting body (20) containing a contoured cavity (50) with diagonal skewed depressions (52) on the inside mounted to the sole of a bicycle shoe. A pedal retaining member (56) is rotatably attached within the contoured cavity, and spring loaded to protrude, exposing a pedal retaining groove (34). The member (56) retracts into the housing releasing the shoe from the pedal when the shoe is rotated solving the previous problem of shoe release, especially in an emergency.

5 Claims, 2 Drawing Sheets

RETRACTABLE BICYCLE SHOE CLEAT

TECHNICAL FIELD

The present invention relates to racing bicycle shoes in general, and more specifically to a quick release cleat allowing the shoe to be safely released from attachment to a bicycle.

BACKGROUND ART

Previously, attempts have been made to produce a shoe for bicycle riding that includes a method of attachment to the pedal that offers a degree of permanence for competitive racing. Currently, devices called pedal chocks, or blocks, are fixed under the sole of a shoe and permit a fixed position of the shoe in respect to the pedal during use. A groove is included in the chock that interfaces with the rear edge of the pedal and locks the shoe in place. While improvements to this device were found, a search of prior art did not reveal any patents that shared the direction of the instant invention. The following U.S. patents were, however, considered related:

| PATENT NO. | INVENTOR | ISSUED |
|---|---|---|
| 4,538,480 | Trindle | 3 September 1985 |
| 4,506,463 | Chassaing | 26 March 1985 |
| 4,377,952 | Gamondes | 29 March 1983 |
| 629,627 | Tomkies | 25 July 1899 |
| 550,409 | Hanson | 26 November 1895 |

Trindle approaches the problem of bicycle pedal attachment in a different manner, that of changing the entire pedal to eliminate the outside structure entirely and add a pair of receiving lugs on a single shaft. A pair of mating male lugs are attached to the shoe and enable the cyclist to provide a 360-degree driving force on each pedal. The shoe is disconnected from the pedal with edgewise movement away from the bicycle, however n moving parts are utilized and both shoe and pedal must be used in matching pairs, replacing both conventional elements.

Chassaing approaches the problem using two separate elongated bars each having a transverse groove therein. The bars are equally spaced one from the other and are parallel to the longitudinal axis of the shoe. Each bar is individually adjusted fore and aft relative to the sole to allow adjustment by the user for comfort and optimum location. The groove, or recess, remains constant in its width and direction.

Gamondes teaches an improvement on the chocks wherein an intermediate piece and an external piece are clamped to a base on the bottom of a shoe by a screw. Mating teeth are included on the contiguous surfaces creating an adjustable member that contains the well known recess, along with a rib front and back. Gamondes provides an adjustment in the location of the recess, but does not include a method of removal from the pedal.

Tomkies discloses a pair of plates that rest upon the pedal and prevents turning by the use of lugs. A center pin is directed through the plates with a hook that passes around the barrel of the pedal forming a pivot for the top plate. The foot of the rider is inserted between the jaws with the sole of the shoe resting against a catch. The foot is then turned to swivel the top plate and close the jaws to grip the sole. The rider is able to both pull upward and push down during the ordinary method of bicycle operation.

Hanson teaches a similar device that is attached to the shoe which comprises several members, including arms, that by turning the foot, are brought into engagement with the bicycle pedal. This movement requires rotation of the foot to both engage and disengage the pedal, and compression is maintained only by continuing the proper orientation in respect to the pedal.

DISCLOSURE OF THE INVENTION

While prior art has attempted to solve the problem of attachment of the foot to a bicycle pedal, the fact remains that most racing bicycles are now equipped with a pedal having the main shaft connected at right angles to the crank arm and a metallic rib looped around in "U" shape. This structure forms a pair of resting members of relatively thin material with an upstanding edge. Upwardly projecting portions maintain side orientation and a toe bracket is attached on the front that loops over the toe and holds it in place. A strap is added around the pedal through the toe bracket. Each racing shoe is equipped with a chock made of structural thermoplastic that is fastened permanently to the sole beneath the ball of the foot. These members contain a locating recess, or groove, which engages the rib of the pedal.

While the method of attachment has proven satisfactory and is well accepted in the art, the problem of detaching the shoe from the pedal has proven to be difficult and dangerous. As the toe of the shoe is held captive within the bracket and the strap maintains the groove of the chock into the pedal, the only method of removing the riders foot from the pedal is to loosen the strap allowing the toe bracket to flex upward disengaging the connection. If for safety reasons some riders do not tighten the strap to the point that it will not allow separation, an annoying amount of movement between the pedal and the shoe is present when upward thrust is applied and the groove is not always engaged. The problems are obviously recognized when the rider falls and one or both feet are still attached to the bicycle, making a dangerous injury prone situation.

It is, therefore, the primary object of the invention to allow the cleat to be disengaged from the edge of the pedal by rotating the foot to the side away from the bicycle. This simple manipulation of the foot is accomplished even with the strap tightly holding the toe in place, as no lateral restraint is present as in the conventional method of attachment. The present invention simply allows a groove containing a retaining member to remain stationary on the pedal while the shoe rotation retracts the member into the cleat. With the member retracted the shoe is easily removed by pulling the foot out of engagement with the device. The retaining member is spring loaded to return to the original position upon removal and is easily replaced on the pedal for attachment in the conventional manner.

An important object of the invention allows the shoe to be walked upon with minimal wear upon the groove containing member, as it is spring loaded. When pressure is placed on the retaining member it retracts, therefore, only spring pressure is applied, rather than the pressure of the foot. One of the problems of prior art is the wearing down of the cleat until it becomes useless, as only a thin segment of plastic material is present behind the groove and takes all of the wear.

Another object of the invention allows replacement of any part, as disassembly of one screw of the invention exposes all of the internal components and allows easy replacement, if necessary.

Still another object of the invention allows the use of a bicycle with no modification or alteration. In most cases racing bicycle pedals are similar and have a toe bracket with a strap and a metallic outer frame. The instant invention is configured to fit the large majority of racing bicycles and the shoe requires only the replacement of the chock and attachment with one mounting screw for assembly.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
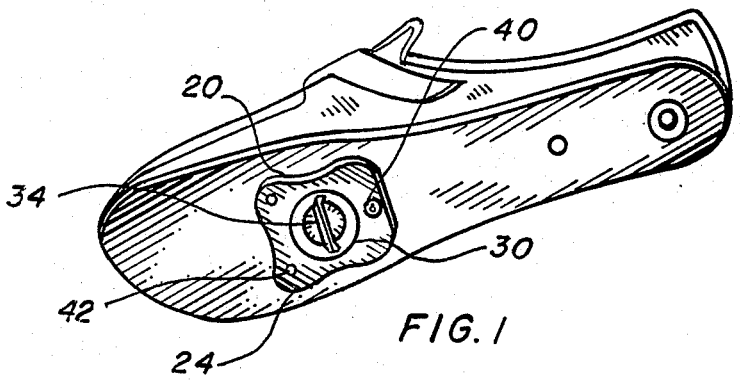
FIG. 1 is a partial isometric view of the preferred embodiment mounted on a racing bicycle shoe.
Figure 2:
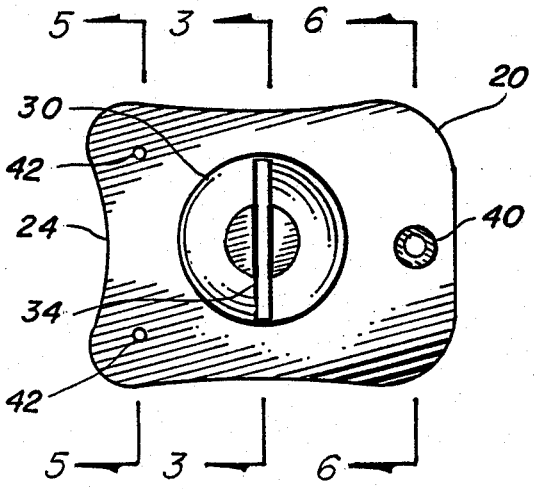
FIG. 2 is a plan view of the preferred embodiment removed completely from a shoe.
Figure 3:
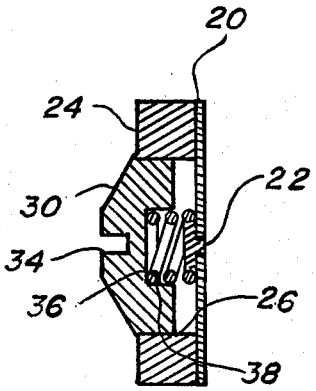
FIG. 3 is a cross-sectional view taken along lines 3—3 of FIG. 2.
Figure 4:
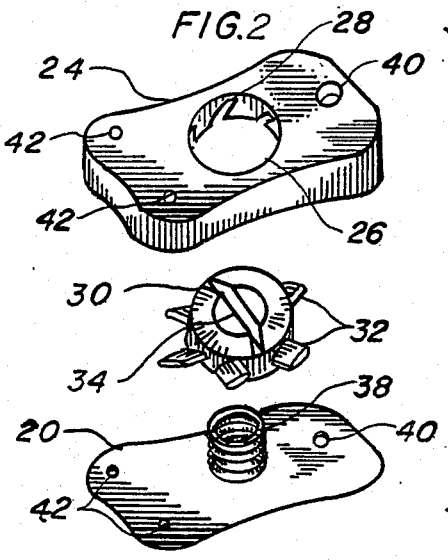
FIG. 4 is an exploded view of the invention removed from a shoe.
Figure 5:
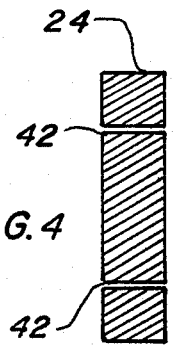
FIG. 5 is a cross-sectional view taken along lines 5—5 of FIG. 2.
Figure 6:
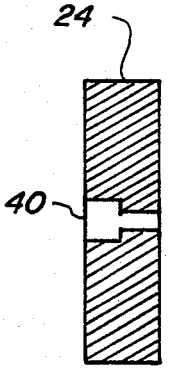
FIG. 6 is a cross-sectional view taken along lines 6—6 of FIG. 2.

The best mode for carrying out the invention is presented in terms of a preferred and a second embodiment. Both embodiments are primarily designed alike, with the exception of the shape of the pedal retaining member. The preferred embodiment is illustrated in FIGS. 1 through 6, and is comprised of a shoe mounting plate 20 the same contour as the sole of a racing bicycle shoe and of a thickness having sufficient strength to hold its shape when installed thereupon. In the relative center of the plate 20 there is a spring guide 22 that is attached permanently. There are two embodiments of this guide 22, the first being a cylindrical pin having a round portion on one end and a shoulder on the other. The guide 22 is attached to the plate 20 by upsetting a head on one side of the plate with the shoulder butting on the plate on the other. This arrangement allows the use of metal as the base material for both components. Steel, aluminum, magnesium or titanium would prove an acceptable material for both components.

Another embodiment of the spring guide 22 is formed from the base material itself being upset as with a male and female die. This method forms a circular boss that is round in shape with radiused corners. The guide may also be an integral part of the plate 20 itself, in the case of metal castings or forgings, or if the material is thermoplastic. The size of the pin or boss is, in any event, of such a shape as to fit snugly on the inside diameter of a compression spring.

A housing 24 is nested upon the plate 20 embracing the plate tightly. This housing 24 has a circular opening 26 in the center with a plurality of outwardly distending radially diagonal tooth cavities 28. These cavities are in communication with only the side that mounts onto the plate 20 and do not extend completely through the housing 24.

A circular disk 30 is formed in a reverse image of the opening and cavity of housing 24 with outwardly projecting diagonal teeth 32 on the periphery. One side of this disk 30 contains a pedal retaining groove 34, and the other side a spring cavity 36. The disk 30 is rotatably disposed within the circular opening 26 with the side containing the groove 34 extending through the cavity approximately the depth of the groove. When the disk 30 is installed within the opening 26 and the teeth 32 are engaging the cavity 28, the disk 30 retracts into the housing 24 when rotated. This movement allows disconnection of the retaining groove 34 from the pedal of a racing bicycle when the shoe containing the cleat is rotated.

The housing 24, disk 30 and even the plate 20 may be made of a thermoplastic material having high impact and tensile strength with a high resistance to abrasion. Acceptable materials include nylons, high density polyethylenes, high-impact sytrenes, polypropylenes, cellulose acetate butyrates, and the like.

A compression spring 38 is retained within the mounting plate spring guide 22 on one end and the circular disk spring cavity 36 on the other. The compressive force of the spring 38 urges the disk 30 partially through the housing maintaining the position of the extended portion until the disk 30 is rotated. The spring 38 allows the disk 30 to retract and then return to the normal extended position when disconnection of the shoe to the pedal has been achieved.

In order to attach the cleat assembly to the shoe, both the plate 20 and housing 24 contain a retaining fastener bore 40 through which a threaded fastener may be inserted. This bore 40 is preferably countersunk to allow the fastener to be flush on the outside surface. A plurality of tack apertures also penetrate the plate 20 and housing 24, allowing a tack to be driven into the sole of the shoe for positioning and to eliminate any tendency to rotate around the screw.

Figure 7:
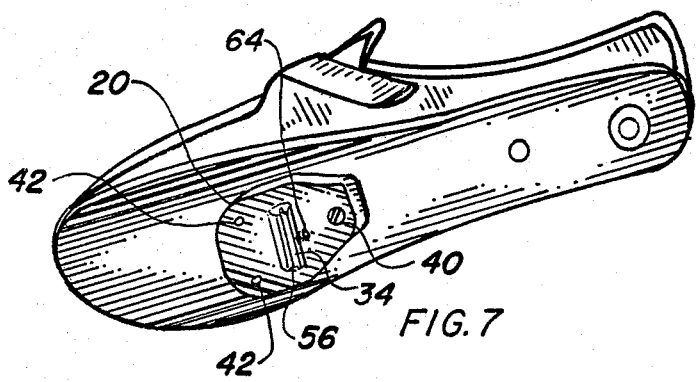
FIG. 7 is a partial isometric view of the preferred embodiment mounted on a racing bicycle shoe.

The second embodiment of the invention is illustrated in FIGS. 7 through 13 and consists of a body 20, the underside of which has the same contour as the sole of a racing bicycle shoe. This body 20 is of a thickness having sufficient strength to maintain its form when mounted to the shoe, as depicted in FIG. 7. The body 20 is contoured with the forward section thinner than that facing the heel of the shoe, so as to provide a raised mounting platform angular to the sole. The corners are radiused and beveled affording a smooth projection free outside surface that does not interfere with the bicycle pedal. A contoured cavity 50 is located in the center of the body 20 and contains a number of outwardly extending skewed depressions 52 radially expanded into the body. This cavity 50 containing the depressions 52 does not extend completely through the body, instead a relatively thin portion remains on the side next to the sole of the shoe. There are two separate opposed depressions 52, and the bottom of the cavity 50 may contain a raised boss 54 in the center thereof, however, this is not necessary for operation of the invention.

A skewed pedal retaining member 56 the approximate shape of the cavity 50, except slightly smaller to allow a sliding fit therebetween, is positioned within the cavity 50. This embodiment incorporates a rectangular shape, as shown pictorially in FIGS. 11 and 12. On the top side of the member 56 is a pedal engaging groove 34 that is elevated somewhat from the surface and extends transversely to the member. This groove 34 is of a width compatible to a conventional racing bicycle pedal and in operation receives this part of the pedal, as the connection holding the shoe onto the bicycle.

The bottom of the member 56 contains a spring cavity 58 in the center that is round in shape and penetrates almost through the member itself. On the two longest ends of the rectangular shaped member, a concave outside radial edge 60 is formed. This edge 60 mates with a similar, but opposite, shape within the cavity 50 of the body 20 forming a track, thereby holding the member 56 in place while rotating within the cavity.

Figure 11:
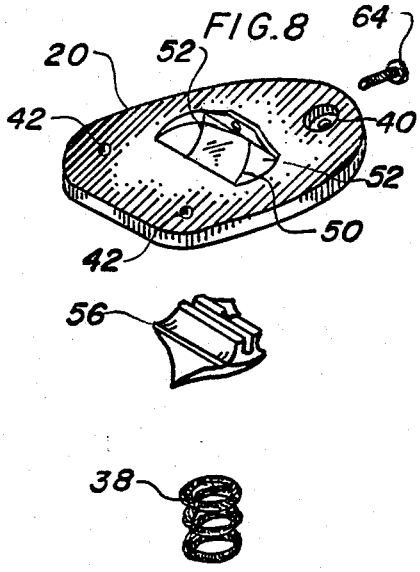
FIG. 11 is an exploded view of the invention removed from a shoe.

The member 56 further contains one or more partial notches 62 formed into the center of the narrowest side, one opposite the other. The notch 62 follows the contoured skewed surface, but does not continue completely through, instead it leaves the bottom surface in tact forming a channel stopping short of the bottom. Only one of these notches 62 is required, as illustrated in FIGS. 11 and 12, however, two may be used in this mode with equal ease.

Figure 8:
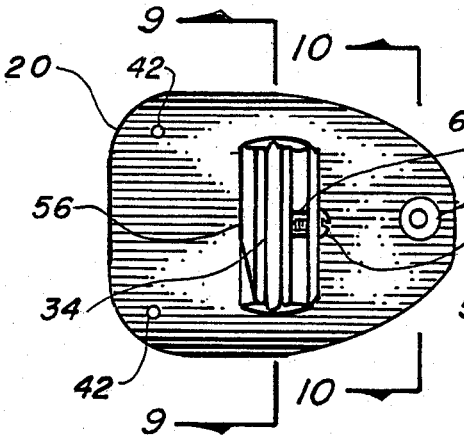
FIG. 8 is a plan view of the preferred embodiment removed completely from a shoe.
Figure 9:
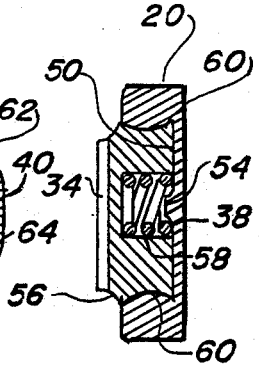
FIG. 9 is a cross-sectional view taken along lines 3—3 of FIG. 8.
Figure 10:
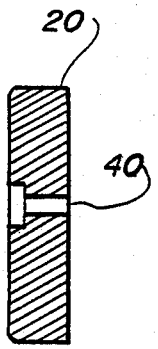
FIG. 10 is a cross-sectional view taken along lines 4—4 of FIG. 8.
Figure 12:
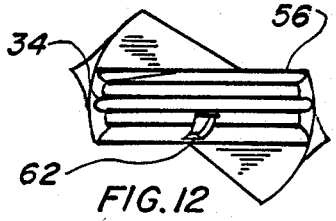
FIG. 12 is a partial isometric view of the skewed pedal retaining member in the rectangular embodiment completely removed from the invention for clarity.
Figure 13:
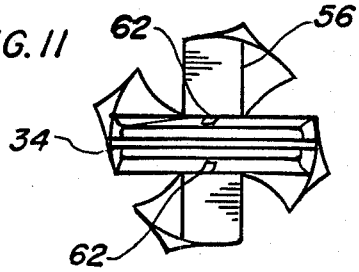
FIG. 13 is a partial isometric view of the skewed pedal retaining member in the round embodiment completely removed from the invention for clarity.

The pedal retaining member 56 further contains a beveled portion on the top forward side, as shown pictorially in FIGS. 12 and 13. This beveled surface allows ease of insertion of the pedal within the engaging groove 34 when initially joining the cleat to the bicycle. In order to captivate the member 56 into the cavity 50 of the body 20, means to accomplish this retension are provided that interface with the notches 62. A plurality of threaded fasteners 64 are removably connected through the body 20 in direct alignment with the partial notches 62 in the member 56 in such a manner as to fill the void there created. This fastener, or fasteners, are inserted after the member 56 is placed into the cavity 50 and allows free rotation, but captivates the member in the cavity when sufficient rotation is achieved. When completely rotated, the bottom portion of the notch 62 is interceded by the fastener 64 stopping the rotation of the member. While FIG. 8 illustrates but one single fastener 64, two or more, may be used depending upon the configuration of the retaining member itself.

In order to maintain a position of the groove 34 relative to the shoe and pedal, a compression spring 38 is retained within the spring cavity 58 of the member 56 and is in communication with the body 20 on one side and the member 56 on the other. This spring 38 urgingly forces the member 56 away from the body 20 maintaining the extended position of the member 56 containing the groove 34 until the member 56 is rotated fully and then returning it to its extended position when released. The spring 38 is retained within the spring cavity 58, however, the raised boss 54 at the bottom of the contoured cavity 50 further assists in alignment of the spring as it grasps the inside diameter of the spring assuring a positive center position.

The body 20 further contains a retaining fastener bore 40 through the flat surface behind the cavity 50. This bore 40 is either countersunk or counterbored to receive a threaded fastener in the form of a screw to compressibly hold the cleat to the racing bicycle shoe. Generally speaking, most present shoes contain a threaded insert within the sole to hold a conventional cleat in place and is well known in the art, and may be utilized by the invention without relocation or modification.

The invention further has a plurality of tack apertures 42, preferably two, located through the forward side of the body 20. This allows the forward portion of the body 20 to be fastened to the sole of the shoe with tacks.

The body 20 and retaining member 56 may be of the same material as the preferred embodiment. The device functions by the rotation of the retaining member 30 or 56 within the body 20 allowing the member to recede into the body when rotated completely disengaging the pedal from the cleat.

In use, the shoe containing the cleat is inserted onto the bicycle pedal with the toe nested into a bracket and the groove 20 firmly in communication with the edge of the pedal. The strap through the toe bracket is tightened and the rider is ready to proceed. When the cyclist is ready to dismount, the option is available to loosen the strap or simply rotate the foot away from the vehicle and slide the foot out. In the case of an emergency, this movement becomes instinctive and may be accomplished quickly and easily.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

I claim:

1. A retractable quick release shoe cleat for attachment to racing bicycles comprising:

(a) a shoe mounting plate having a spring guide therein, in the same shape as the sole of a racing bicycle shoe and attached thereon, (b) a housing having a first and second side contiguously embracing said plate on the first side, the housing further having a circular opening in the center with a plurality of outwardly distending radially diagonal tooth cavities in communication with the first side only, (c) a circular disk having a pedal retaining groove on one side and a spring cavity on the other, with a plurality of outwardly projecting diagonal teeth on the periphery, rotatably disposed within said circular opening extending a portion beyond the second side of said housing in such a manner as to retract within the housing when rotated allowing disconnection of the retaining groove to a pedal of a racing bicycle when a shoe containing said cleat is attached thereupon, and, (d) a compression spring retained within said mounting plate spring guide on one end and said circular disk spring cavity on the other urgingly forcing the disk partially through maintaining the position of the extended portion until the disk is rotated and then returning the disk to its extended position when disconnection has been achieved.

2. The invention as recited in claim 1 wherein said shoe mounting plate spring guide further comprises, a cylindrical pin having a shoulder attached by upsetting a head on one side of the plate against the shoulder on the other.

3. The invention as recited in claim 1 wherein said shoe mounting plate spring guide further comprises, a circular boss upset within the parent material of the mounting plate with an outside diameter to fit snugly upon the inside diameter of said spring.

4. The invention as recited in claim 1 further comprising, said mounting plate and said housing together having a retaining fastener bore through which a threaded fastener may be inserted to compressibly hold the cleat onto a racing bicycle shoe.

5. The invention as recited in claim 1 further comprising; said mounting plate and said housing together having a plurality of tack apertures therethrough to fasten the plate and housing to the sole of a bicycle shoe.

* * * * *